US008657152B2

(12) United States Patent
Bando et al.

(10) Patent No.: US 8,657,152 B2
(45) Date of Patent: Feb. 25, 2014

(54) WET TISSUE PACKAGE, MANUFACTURING METHOD OF WET TISSUE PACKAGE AND MANUFACTURING DEVICE OF WET TISSUE PACKAGE

(75) Inventors: Takeshi Bando, Kagawa (JP); Takahiro Ueda, Kagawa (JP); Ikue Hiramatsu, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 13/380,917

(22) PCT Filed: Mar. 31, 2010

(86) PCT No.: PCT/JP2010/002390

§ 371 (c)(1), (2), (4) Date: Mar. 27, 2012

(87) PCT Pub. No.: WO2011/001574

PCT Pub. Date: Jan. 6, 2011

(65) Prior Publication Data

US 2012/0175280 A1 Jul. 12, 2012

(30) Foreign Application Priority Data

Jul. 3, 2009 (JP) ..... 2009-158761
Mar. 24, 2010 (JP) ..... 2010-067314

(51) Int. Cl.
*A47K 10/24* (2006.01)
*B65D 69/00* (2006.01)

(52) U.S. Cl.
USPC ..... 221/47; 206/233; 206/494

(58) Field of Classification Search
USPC ..... 206/233, 494; 221/34, 45–48
See application file for complete search history.

(56) References Cited

U.S. PATENT DOCUMENTS 2,080,729 A * 5/1937 McConnell ..... 221/50
2,761,676 A 9/1956 Sabee et al.
5,565,258 A 10/1996 McConnell et al.
5,716,691 A 2/1998 Chan (Continued)

FOREIGN PATENT DOCUMENTS

JP 2007144053 A 6/2007
JP 2009126549 A 6/2009

OTHER PUBLICATIONS

Internation Search Report for PCT/JP2010/002390 dated Jun. 22, 2010.

(Continued)

*Primary Examiner* — Bryon Gehman
(74) *Attorney, Agent, or Firm* — Lowe Hauptman & Ham LLP

(57) ABSTRACT

To provide a wet tissue package that allows for easy taking out of a wet tissue accommodated in a package body. A wet tissue package includes: a package body having an opening; and a plurality of wet tissues accommodated in the package body in a state of being individually folded and stacked without being interfolded, in which each of the plurality of wet tissues includes: a first folding line parallel to the first side edge; a second folding line parallel to the first folding line; and a turn-back portion formed by folding the wet tissue on the first folding line and the second folding line, in which the turn-back portion is directed toward the opening and a part of the turn-back portion is disposed so as to be exposable through the opening.

19 Claims, 10 Drawing Sheets

(56) References Cited

U.S. PATENT DOCUMENTS

| | | | | |
|---|---|---|---|---|
| 6,109,430 | A | 8/2000 | Bando et al. | |
| 6,213,344 | B1 * | 4/2001 | Hill | 221/46 |
| 6,543,643 | B2 * | 4/2003 | Iida et al. | 221/48 |
| 6,644,501 | B2 * | 11/2003 | Iida | 221/48 |
| 2002/0038805 | A1 | 4/2002 | Iida et al. | |

OTHER PUBLICATIONS

EESR issued to EP Application No. EP10793752.6 , mailed Apr. 3, 2013.

* cited by examiner

WET TISSUE PACKAGE, MANUFACTURING METHOD OF WET TISSUE PACKAGE AND MANUFACTURING DEVICE OF WET TISSUE PACKAGE

RELATED APPLICATIONS

This application is a National Stage of PCT international application Ser. No. PCT/JP2010/002390 filed on Mar. 31, 2010 which is based upon and claims the benefit of priority of Japanese Application Number 2009-158761 filed Jul. 3, 2009 and Japanese Application Number 2010-067314 filed Mar. 24, 2010.

TECHNICAL FIELD

The present invention relates to a wet tissue package, a manufacturing method of a wet tissue package, and a manufacturing device of a wet tissue package. More particularly, the present invention relates to a wet tissue package including a package body having an opening and a plurality of wet tissues accommodated in the package body in a stacked manner, a manufacturing method of a wet tissue package, and a manufacturing device of a wet tissue package.

BACKGROUND ART

A wet tissue package has been known to the inventor(s) as including a package body having an opening and a plurality of wet tissues accommodated in the package body in a stacked manner. In such a wet tissue package, the plurality of wet tissues are accommodated in the package body in an individually folded manner along a predetermined folding line and stacked. The wet tissues accommodated in the package body are used by taking out one by one from the opening. Here, when a wet tissue is taken out from the opening, a side edge portion thereof directed toward the opening is pinched (i.e., grasped by the fingers of a user).

In this case, the plurality of wet tissues accommodated in the package body in a stacked manner adhere to each other due to moisture contained therein and are difficult to pinch. Given this, various techniques have been proposed for making the side edge portion of the plurality of wet tissues accommodated in the package body easy to pinch.

For example, a technique of cutting a side edge of a wet tissue into a wave shape has known to the inventor(s). In addition, a technique of providing embossing in the vicinity of a side edge of a wet tissue has been known to the inventor(s).

SUMMARY OF INVENTION

The inventor(s) have discovered that the above-described one technique of cutting merely forms a side edge portion of the wet tissue in a nonlinear shape, and is unlikely to make the wet tissue easier to pinch. In addition, in the other technique, since the wet tissue is pressed by being stacked, concavities and convexities formed by embossing are compressed and the side edge portion of the wet tissue is unlikely made sufficiently easier to pinch.

Therefore, there is a need for providing a wet tissue package that allows an easy taking out of a wet tissue accommodated in a package body, a manufacturing method of a wet tissue package, and a manufacturing device of a wet tissue package.

An aspect of the present invention relates to a wet tissue package including a package body having an opening; and a plurality of wet tissues accommodated in the package body in a state of being folded and stacked, in which a side of each of the plurality of wet tissues facing the opening is folded to define a multi-layered structure exposable through the opening to facilitate pinching.

A further aspect of the present invention relates to a wet tissue package including a package body having an opening and a plurality of wet tissues accommodated in the package body in a state of being folded and stacked without being interfolded, in which the wet tissue includes: a first side edge; a double-folded portion formed by double-folding the wet tissue at a position away from the first side edge by a predetermined width; and a folded end portion formed by further turning back an end side of the double-folded portion.

An another aspect of the present invention relates to a manufacturing method of a wet tissue package including a wet tissue stacked body in which a first wet tissue folded on a folding line formed at a predetermined position and a second wet tissue folded on a folding line formed at a position different from the folding line of the first wet tissue are alternately stacked, the method includes: a feeding step of feeding first whole cloth in a rolled state and second whole cloth in a rolled state; a first folding step of folding back the first whole cloth fed in the feeding step in a width direction of the first whole cloth, to form a continuous body of the first wet tissue; a second folding step of folding back the second whole cloth fed in the feeding step in a width direction of the second whole cloth, to form a continuous body of the second wet tissue; a first impregnation step of impregnating the continuous body of the first wet tissue with a liquid from a first face of the continuous body of the first wet tissue; a second impregnation step of impregnating the continuous body of the second wet tissue with the liquid from a first face of the continuous body of the second wet tissue; and a piling step of forming a layered body of the continuous body of the first wet tissue and the continuous body of the second wet tissue, by piling the continuous body of the first wet tissue and the continuous body of the second wet tissue such that a second face of the continuous body of the first wet tissue and the first face of the continuous body of the second wet tissue are in contact with each other.

A yet another aspect of the present invention relates to a manufacturing device of a wet tissue package including a wet tissue stacked body in which a first wet tissue folded on a folding line formed at a predetermined position and a second wet tissue folded on a folding line formed at a position different from the folding line of the first wet tissue are alternately stacked, the device includes: a feeding means for feeding first whole cloth in a rolled state and second whole cloth in a rolled state; a first folding means for folding back the first whole cloth fed in the feeding step in a width direction of the first whole cloth, to form a continuous body of the first wet tissue; a second folding means for folding back the second whole cloth fed in the feeding step in a width direction the second whole cloth, to form a continuous body of the second wet tissue; a first impregnation means for impregnating the continuous body of the first wet tissue with a liquid from a first face of the continuous body of the first wet tissue; a second impregnation means for impregnating the continuous body of the second wet tissue with the liquid from a first face of the continuous body of the second wet tissue; and a piling means for forming a layered body of the continuous body of the first wet tissue and the continuous body of the second wet tissue, by piling the continuous body of the first wet tissue and the continuous body of the second wet tissue such that a second face of the continuous body of the first wet tissue and the first face of the continuous body of the second wet tissue are in contact with each other.

DESCRIPTION OF EMBODIMENTS

Figure 1:
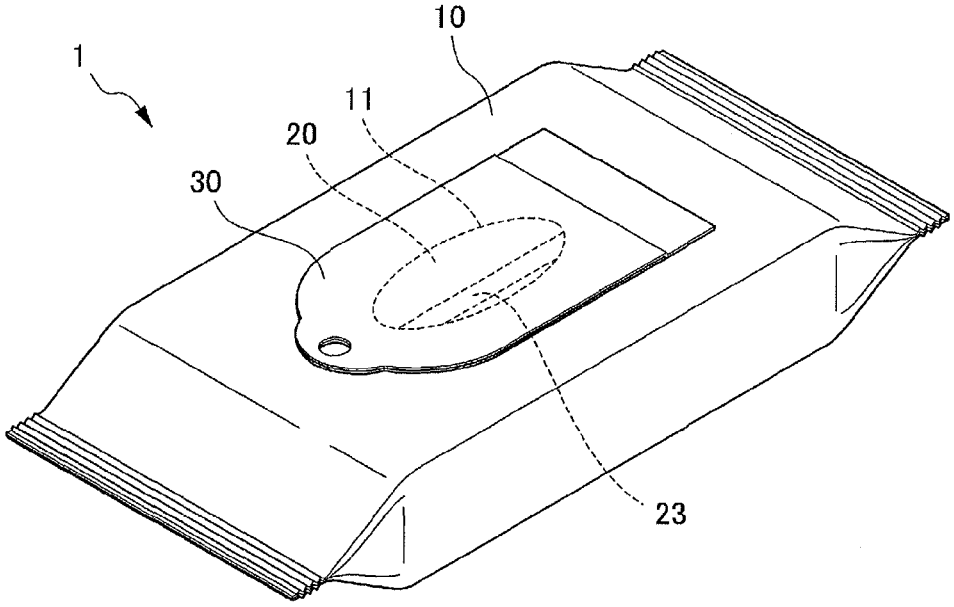
FIG. 1 is a perspective view showing a first embodiment of a wet tissue package of the present invention.
Figure 2:
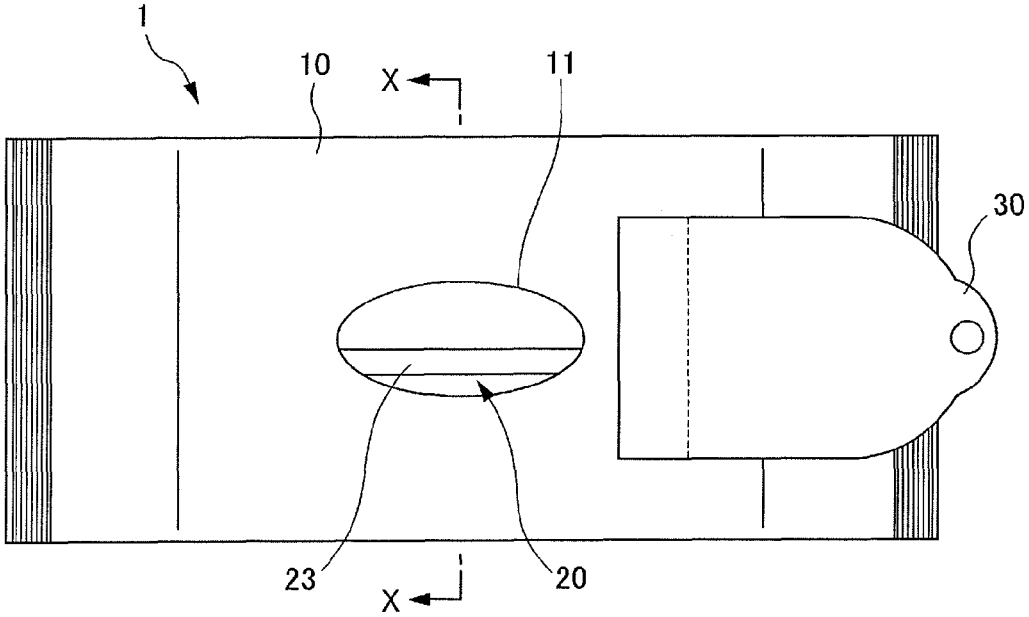
FIG. 2 is a plan view showing a state where a closure flap of the wet tissue package shown in FIG. 1 is peeled.
Figure 3:
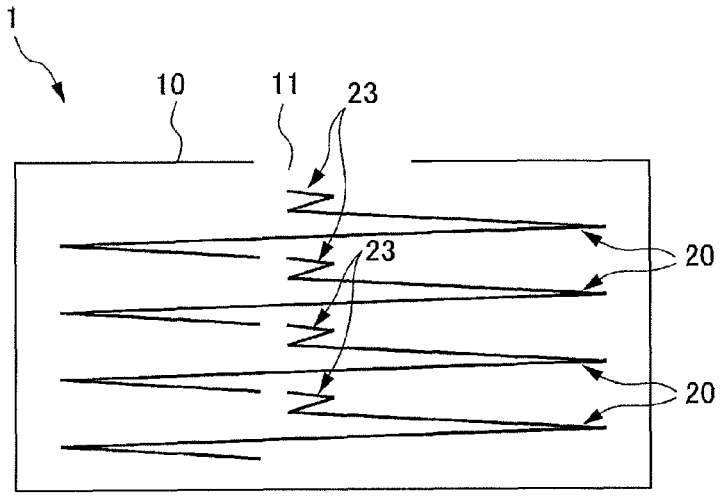
FIG. 3 is a cross-sectional view taken along a line X-X shown in FIG. 2.

Preferred, but non-limiting, embodiments of the wet tissue package according to the present invention are described hereinafter with reference to the drawings. FIG. 1 is a perspective view showing a wet tissue package according to a first embodiment and FIG. 2 is a plan view thereof. FIG. 3 is a cross-sectional view taken along a line X-X shown in FIG. 2.

The wet tissue package 1 according to the first embodiment includes, as shown in FIGS. 1 to 3, a package body 10 having an opening 11, a plurality of wet tissues 20 accommodated in the package body 10, and a closure flap 30 that is attached to an outer face of the packaging body 10 and covers the opening 11.

The package body 10 is, as shown in FIGS. 1 and 2, composed of a sheet member or members and formed in a bag shape that is substantially rectangular in plan view. Examples of such sheet member composing the package body 10 include, but are not limited to, a liquid impermeable film material formed by laminating polyethylene terephthalate film, aluminum foil and the like.

The opening 11 is provided in a substantially central portion of a top face of the package body 10. The opening 11 may be formed by cutting out a portion of the sheet member composing the package body 10.

The closure flap 30 has, as shown in FIG. 2, a substantially rectangular shape with one end edge in a longitudinal direction being formed in an arcuate shape. The closure flap 30 is attached to the package body 10 such that a longitudinal direction of the closure flap 30 is oriented along a longitudinal direction of the package body 10.

More specifically, a portion of the closure flap 30 on the side of the opposite end edge, in other words the end edge formed in a linear shape as shown in FIGS. 1-2, adheres to an outer face of the package body 10 so as to be difficult to peel.

In addition, a portion of the closure flap 30, other than the portion adhering to the outer face of the package body 10 so as to be difficult to peel, covers the opening 11 and adheres to a peripheral part of the opening 11 on the package body 10 so as to be peelable. The closure flap 30 may be composed of a synthetic resin film such as polyethylene, polypropylene, polyester, polyamide, polyvinyl chloride and the like. The closure flap 30 can also have a multilayered structure in which at least two sheets are laminated.

Figure 4:
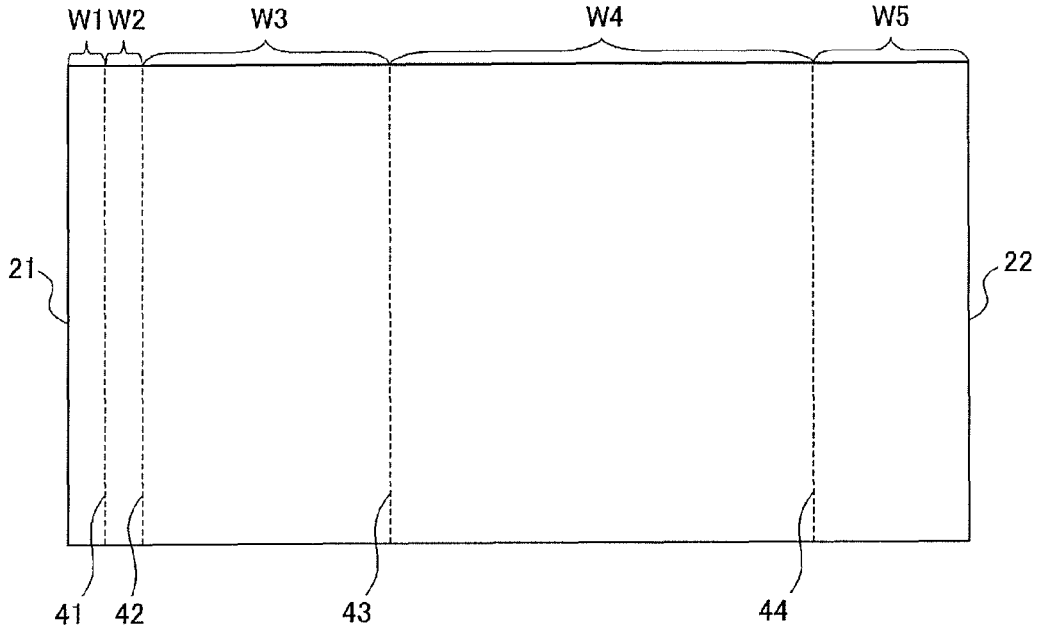
FIG. 4 is a developed view showing a wet tissue according to the first embodiment.
Figure 5:
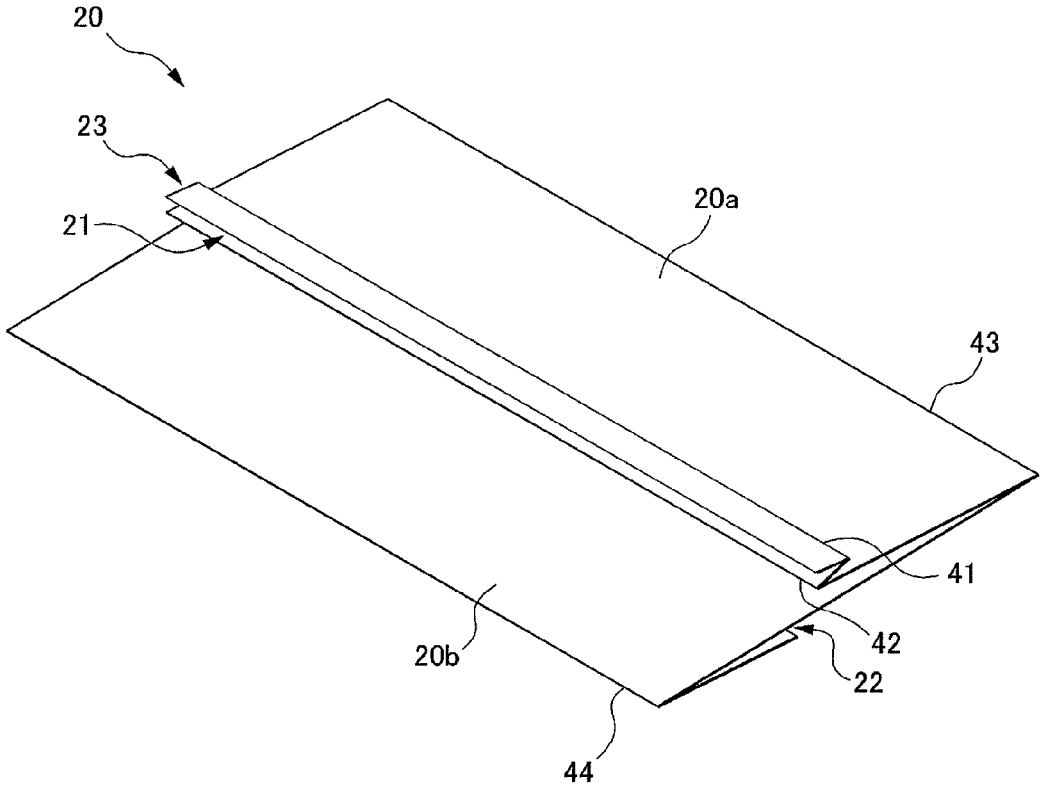
FIG. 5 is a perspective view showing the wet tissue according to the first embodiment.

FIG. 4 is a developed view showing a wet tissue 20 according to the first embodiment. FIG. 5 is a perspective view of the wet tissue 20, and FIG. 6 is a diagram schematically showing a folded state of the wet tissue 20.

As shown in FIG. 4, the plurality of wet tissues 20 are each formed in a substantially rectangular shape. Each wet tissue 20 has, between a first side edge 21 that is one of a pair of side edges extending in a width direction and a second side edge 22 that is opposite thereto, a first folding line 41, a second folding line 42, a third folding line 43, and a fourth folding line 44, and is folded by folding along the first folding line 41, the second folding line 42, the third folding line 43, and the fourth folding line 44, as shown in FIGS. 4 to 6. The wet tissue has a first, upper, face 20*a* (the face shown in FIG. 4) and a second, underside, face 20*b*. Furthermore, the wet tissue 20 in a folded state has a turn-back portion 23 formed by folding the wet tissue 20 along the first folding line 41 and the second folding line 42.

Figure 6:
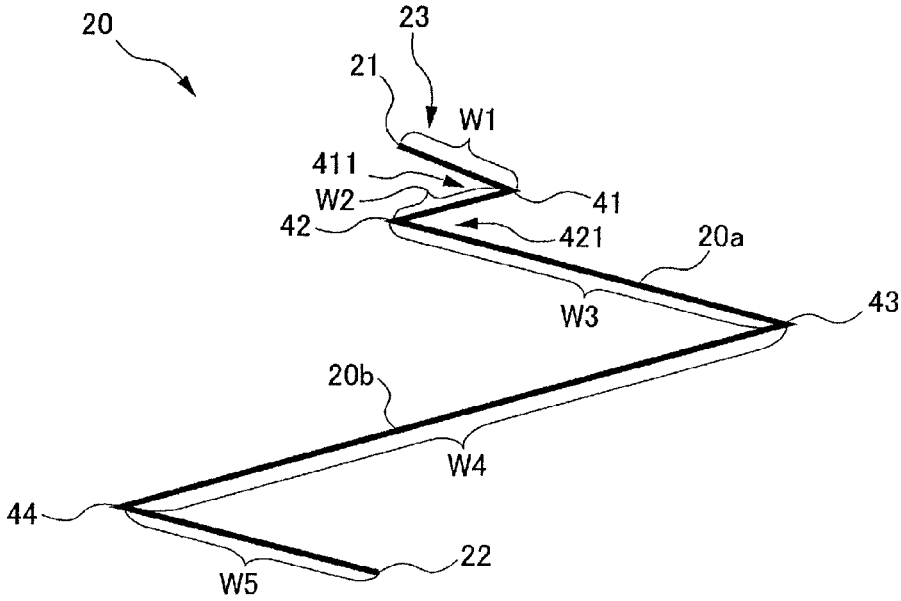
FIG. 6 is a diagram schematically showing a folded state of the wet tissue according to the first embodiment.

As shown in FIGS. 4 and 6, the first folding line 41 is provided at a position away from the first side edge 21 by a first width W1, so as to be substantially parallel to the first side edge 21. The second folding line 42 is provided at a position away from the first folding line 41 by a second width W2 so as to be substantially parallel to the first folding line 41. The third folding line 43 is provided at a position away from the second folding line 42 by a third width W3 so as to be substantially parallel to the second folding line 42. The fourth folding line 44 is provided at a position away from the third folding line 43 by a fourth width W4 so as to be substantially parallel to the third folding line 43. A width from the fourth folding line 44 to the second side edge 22 is a fifth width W5.

According to the first embodiment, each wet tissue 20 is folded along the second folding line 42 such that the first face 20*a* of the wet tissue 20 faces itself, and along the first folding line 41 such that the second face 20*b* of the wet tissue 20 faces itself, as shown in FIGS. 5 and 6. In addition, each wet tissue 20 is folded along the third folding line 43 such that the second face 20*b* faces itself, and along the fourth folding line 44 such that the first face 20*a* faces itself. In other words, in the first embodiment, the turn-back portion 23 is formed by folding the wet tissue 20 along the second folding line 42 toward the first face 20*a* and along the first folding line 41 toward the second face 20*b*. It is thus folded in a series of "Z" folds.

Exemplary relationships among the first width W1, the second width W2, the third width W3, the fourth width W4, and the fifth width W5 are described hereafter.

The length of the first width W1 and the length of the second width W2 are configured to be substantially equal. The length of the third width W3 is configured to be greater than the length of the first width W1 and the length of the second width W2, and smaller than a length of the fourth width W4. The length of the third width W3 may be about one-third to two-thirds of the length of the fourth width W4 for example. The length of the fourth width W4 is configured to be equal to or greater than a sum of the length of the third width W3 and the length of the fifth width W5. By thus configuring the lengths of the first to fifth widths, the turn-back portion 23 is preferably positioned in a substantially central portion in a direction orthogonal to a direction in which the first to fourth folding lines 41 to 44 of the wet tissue 20 in a folded state extend (see FIG. 3).

In addition, as shown in FIGS. 3 and 6, the wet tissue 20 thus folded is in a four-layered structure in a portion where the turn-back portion 23 is formed; and a bilayered structure in a portion where the turn-back portion 23 is not formed. In other words, the portion where the turn-back portion 23 is formed is configured to be greater in thickness, by a thickness of two layers, than the portion where the turn-back portion 23 is not formed in some embodiments.

The plurality of wet tissues 20 are accommodated in the package body 10 in a state of being individually folded and stacked without being interfolded or interlocked with each other, as shown in FIG. 3. As described above, the turn-back portion 23 of each of the plurality of wet tissues 20 is preferably positioned in a substantially central portion in a direction orthogonal to a direction in which the first to fourth folding lines 41 to 44 of the wet tissue 20 in a folded state extend. Therefore, a part of the turn-back potion 23 is disposed so as to be exposable through the opening 11 of the package body 10. In other words, the exposable part of the turn-back potion 23 of each of the plurality of wet tissues 20 is disposed at a position corresponding to the opening 11 in a stacking direction. As shown in non-limiting embodiments of FIGS. 2-3, a width of the turn-back portion 23 is shorter than that of the opening 11. In other words, the entire width of the turn-back portion 23 is exposable through the opening 11.

As shown in FIG. 1, in the abovementioned wet tissue package 1, the opening 11 is covered by the closure flap 30 when not being used, in order to keep moisture in the wet tissues 20 accommodated in the package body 10. When the wet tissue package body 1 is used, the closure flap 30 is peeled to expose the opening 11. The wet tissue 20 disposed in an uppermost layer of the plurality of wet tissues 20 is thus exposed through the opening 11 as shown in FIG. 2. Since the turn-back portion 23 of the wet tissue 20 is disposed at a position corresponding to the opening 11, a part of the turn-back portion 23 is exposed through the opening 11.

Next, the turn-back portion 23 exposed through the opening 11 is pinched to take out the wet tissue 20. Here, since the turn-back portion 23 is formed by folding the wet tissue 20 along the first folding line 41 and the second folding line 42, the turn-back portion 23 is disposed at a position higher by a thickness of two layers than other portions. In other words, the turn-back portion 23 is exposed through the opening 11 in a state of being easy to pinch. Both the first folding line 41 and the second folding line 42 of the turn-back portion 23 form a gap 411, 421 inside the turn-back portion 23. In other words, even when the sheet of the wet tissue is in a wet state, since the sheet does not tightly adhere to itself and has a doubled thickness along the first and second folding lines 41 and 42, the first and second folding lines 41 and 42 have a sufficient thickness that a user's finger can be easily hooked onto. Furthermore, since the sheet does not tightly adhere to itself, the sheet can be easily deformed with a finger and a user's finger can be easily hooked onto the turn-back portion 23.

In addition, the plurality of wet tissues 20 are stacked without being interfolded or interlocked. As a result, when the wet tissue 20 in an uppermost layer is taken out through the opening 11, the wet tissue 20 disposed in an adjacent layer below does not project through the opening 11.

The wet tissue package according to the first embodiment produces at least the following effects, amongst other effects.

(1) The wet tissues 20 accommodated in the package body 10 in a state of being stacked adhere together due to moisture contained therein and might be difficult to pinch. Given this, the turn-back portion 23 is formed by folding the wet tissue 20 along the first folding line 41 and the second folding line 42. This can dispose the turn-back portion 23 exposed through the opening 11 higher by a thickness of two layers than other portions. As a result, the turn-back portion 23 is exposed through the opening 11 so as to be easy to pinch, and thus the wet tissues 20 accommodated in the package body 10 become easier to take out.

(2) The turn-back portion 23 is formed by folding each of the plurality of wet tissues 20 along the second folding line 42 such that the first face 20*a* faces itself, and along the first folding line 41 such that the second face 20*b* faces itself. As a result, the wet tissue 20 can be in an opened state when the wet tissue 20 is taken out through the opening 11. Convenience of the wet tissue package 1 can thus be improved.

(3) Each of the plurality of wet tissues 20 is folded along the fourth folding line 44 such that the first face 20*a* faces itself. This can reduce the size of the wet tissue 20 in a folded state in a plan view, and thus the size of the wet tissue package body 1 can also be reduced.

The second embodiment of the wet tissue package 1 according to the present invention is described hereinafter with reference to FIGS. 7 and 8. In the following description of the embodiment, the same components are denoted by the same reference numerals, and descriptions thereof will be omitted or simplified.

Figure 7:
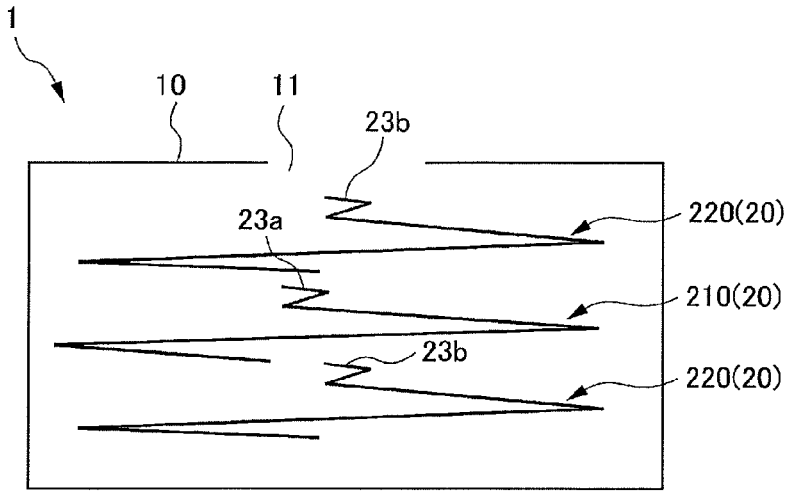
FIG. 7 is a cross-sectional view similar to FIG. 3, showing a wet tissue package according to a second embodiment.
Figure 8:
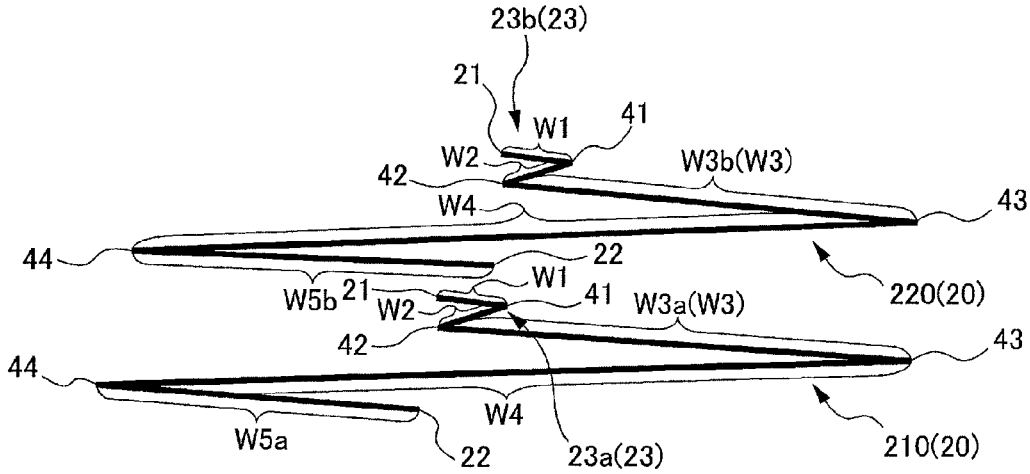
FIG. 8 is a partially enlarged view of FIG. 7.

FIG. 7 is a cross-sectional view similar to FIG. 3 showing the wet tissue package 1 according to the second embodiment, and FIG. 8 is an enlarged view of part of FIG. 7.

The wet tissue package 1 according to the second embodiment is different from the first embodiment in that the plurality of wet tissues 20 include first wet tissues 210 and second wet tissues 220.

More specifically, as shown in FIGS. 7 and 8, a second length W3*b*, which is a length of a third width W3 in the second wet tissue 220, is configured to be smaller than a first length W3*a*, which is a length of the third width W3 in the first wet tissue 210, by approximately a length of the second width W2. In addition, a length of a fifth width W5*b* in the second wet tissue 220 is configured to be slightly greater than a length of the fifth width W5*a* in the first wet tissue 210. A length of the fourth width W4 in the second wet tissue 220 is configured to be equal to a length of the fourth width W4 in the first wet tissue 210.

In such a configuration, the first wet tissue 210 and the second wet tissue 220 can be obtained using the wet tissues 20 of the same size.

In the second embodiment, the first wet tissue 210 and the second wet tissue 220 are accommodated in the package body 10 in a state of being alternately stacked, as shown in FIG. 7. Here, a second length W3*b* of the third width W3 in the second wet tissue 220 is configured to be smaller than the first length W3*a* of the third width W3 in the first wet tissue 210, by approximately a length of the second width W2. As a result, a turn-back portion 23*a* of the first wet tissue 210 and a turn-back portion 23*b* of the second wet tissue 220 are disposed at positions not overlapping each other in plan view, in a state where the plurality of wet tissues 20 are stacked. In the folded state, each of the plurality of wet tissues defines an at least four-layered structure where the turn-back portion is formed and an one- or two-layered structure where the turn-back portion is not formed.

The wet tissue package 1 according to the second embodiment produces the following effect(s), in addition the above-mentioned effects (1) to (3).

(4) A length W3*b* of the third width W3 in the second wet tissue 220 is configured to be smaller than the length W3*a* of the third width W3 in the first wet tissue 210. In such a configuration, the turn-back portion 23*a* of the first wet tissue 210 and the turn-back portion 23*b* of the second wet tissue 220 can be disposed at positions not overlapping each other in plan view. As a result, the height of the wet tissue package 1 can be reduced when the plurality of wet tissues 20 are stacked.

Figure 9:
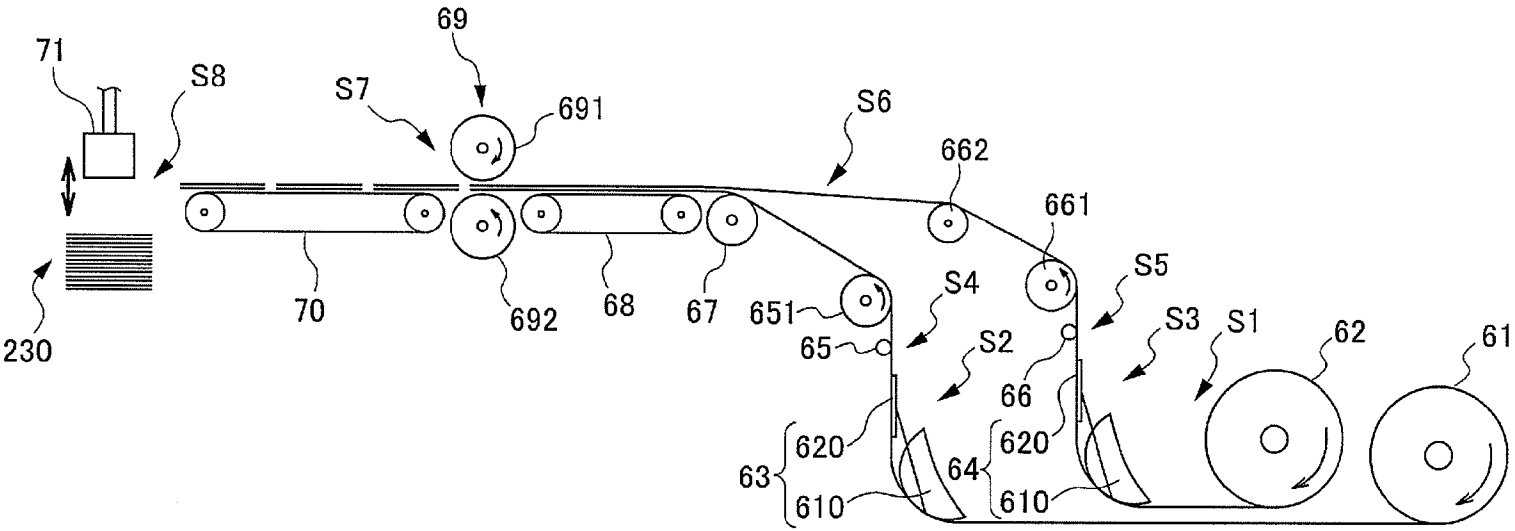
FIG. 9 is a diagram schematically showing a manufacturing device and manufacturing steps of the wet tissue package 1 according to the second embodiment.
Figure 10:
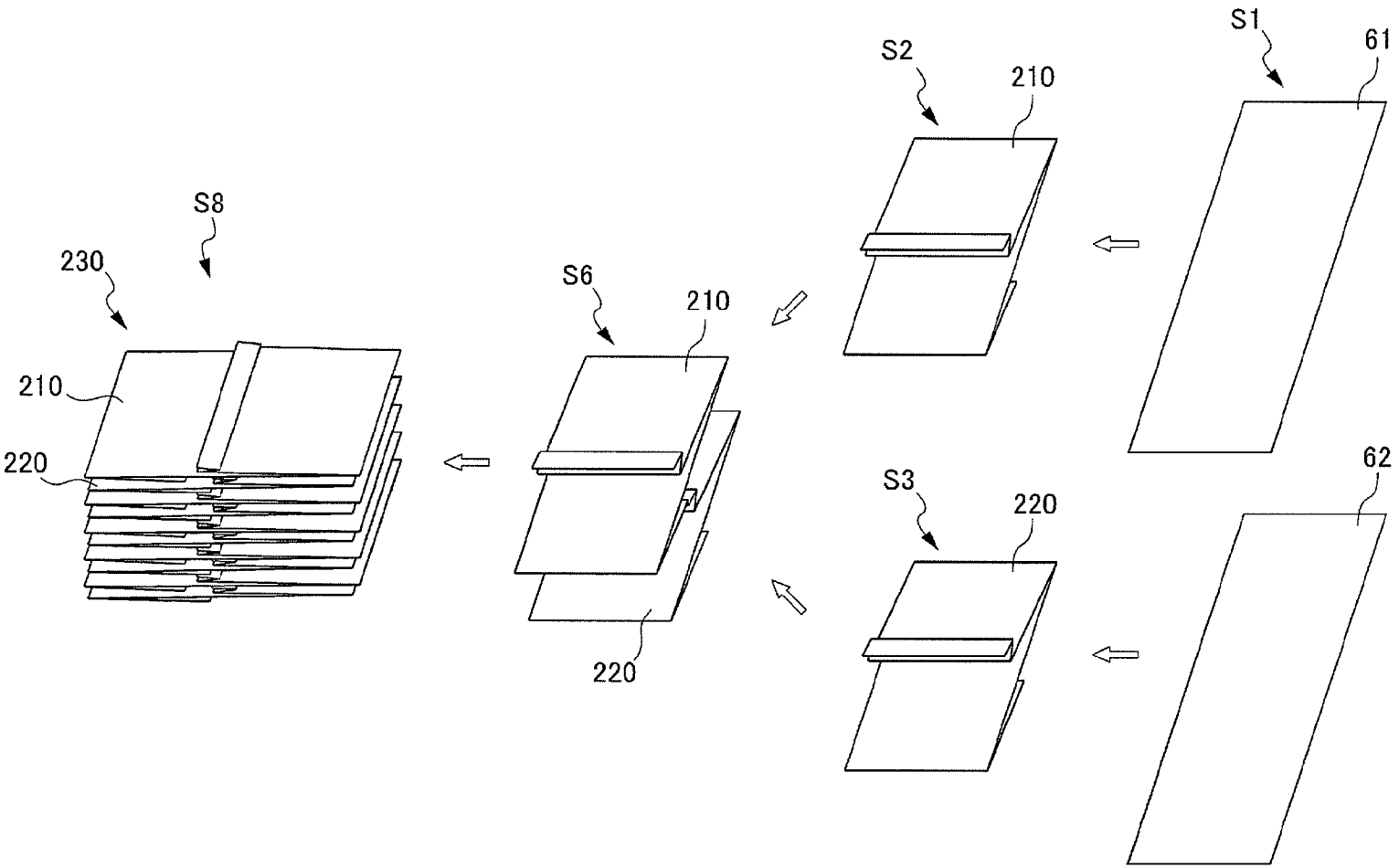
FIG. 10 is a perspective view showing the wet tissue in a state of each step of FIG. 9

Next, a mode of a manufacturing method of a wet tissue package 1 according to the second embodiment is described hereinafter with reference to FIGS. 9 and 10. FIG. 9 is a diagram schematically showing a manufacturing device and manufacturing steps of the wet tissue package 1 according to the second embodiment. FIG. 10 is a perspective view showing the wet tissue in a state of each step of FIG. 9.

The manufacturing method of the wet tissue package according to the present mode is a manufacturing method of the wet tissue package 1 including a wet tissue stacked body 230 in which a first wet tissue 210 folded on a folding line provided at a predetermined position and a second wet tissue 220 folded on a folding line provided at a position different from the folding line of the first wet tissue 210 are alternately stacked. The manufacturing method of the wet tissue package 1 includes, as shown in FIGS. 9 and 10, a feeding step S1, a first folding step S2, a second folding step S3, a first impregnation step S4; a second impregnation step S5, a piling step S6, a cutting step S7, and a stacking step S8.

In addition, the manufacturing device of the wet tissue package used in the manufacturing method of the wet tissue package according to the present mode includes: a feeding means; a first folding means 63; a second folding means 64; a first impregnation means 65; a second impregnation means 66; a piling means 67; a cutting means 69; and a stacking means 71.

In the feeding step S1, as shown in FIG. 9, a first whole cloth 61 in a rolled state and a second whole cloth 62 in a rolled state are fed.

As the first whole cloth 61 and the second whole cloth 62, for example, nonwoven fabric of 30 to 70 g/m$^2$ in basis weight configured in a sheet shape by way of a spun-lace method can be appropriately used. In addition, in a case where nonwoven fabric is used as the first whole cloth 61 and the second whole cloth 62, the nonwoven fabric is preferably composed to include hydrophilic fiber from a viewpoint of appropriately absorbing a chemical solution in the first impregnation step S4 and the second impregnation step S5.

In the first folding step S2, the first whole cloth 61 fed in the feeding step S1 is folded back in a width direction of the first whole cloth 61 by the first folding means 63, thereby forming a continuous body of the first wet tissue 210.

In the second folding step S3, the second whole cloth 62 fed in the feeding step S1 is folded back in a width direction of the second whole cloth 62 by the second folding means 64, thereby forming a continuous body of the second wet tissue 220.

As the first folding means 63 and the second folding means 64, for example, a folding device including a folding board 610 separated into right and left with a predetermined folding edge (not shown) and a positioning stay 62 including a movable adjustment mechanism (not shown) can be used.

In the first impregnation step S4, the continuous body of the first wet tissue 210 is impregnated with the chemical solution as the liquid from a first face of the first wet tissue 210 by the first impregnation means 65.

The first impregnation means 65 is composed to include: an impregnation roller having a plurality of pores formed on a surface thereof, from which the chemical solution can be discharged; a chemical solution tank (not shown) that houses the chemical solution as a liquid; and a pump (not shown) that supplies the chemical solution from the chemical solution tank to the impregnation roller. In the present mode, the impregnation roller constituting the first impregnation means 65 is disposed so as to contact the first face of the continuous body of the first wet tissue 210 being conveyed and the chemical solution is discharged from the impregnation roller, thereby impregnating the continuous body of the first wet tissue 210 with the chemical solution.

In the second impregnation step S5, the continuous body of the second wet tissue 220 is impregnated with the chemical solution from a first face of the second wet tissue 220 by the second impregnation means 66.

The second impregnation means 66 has a similar configuration to that of the first impregnation means 65. In the present mode, the impregnation roller constituting the second impregnation means 66 is disposed so as to contact the first face of the continuous body of the second wet tissue 220 being conveyed and the chemical solution is discharged from the impregnation roller, thereby impregnating the continuous body of the second wet tissue 220 with the chemical solution.

In the piling step S6, the continuous body of the first wet tissue 210 impregnated with the chemical solution and the continuous body of the second wet tissue 220 impregnated with the chemical solution are piled by a piling roller 67 as the piling means. More specifically, in the piling step S6, the continuous body of the first wet tissue 210 and the continuous body of the second wet tissue 220 are piled such that a second face of the continuous body of the first wet tissue 210 conveyed by a conveying roller 651 and the first face of the continuous body of the second wet tissue 220 conveyed by conveying rollers 661 and 662 are in contact with each other. A layered body of the continuous body of the first wet tissue 210 and the continuous body of the second wet tissue 220 is thus formed.

In the abovementioned piling step S6, the first wet tissue 210 and the second wet tissue 220 are piled such that the second face of the first wet tissue 210 on a side not impregnated with the chemical solution and the first face of the second wet tissue 220 on a side impregnated with the chemical solution are in contact with each other. As a result, like faces impregnated with the chemical solution of the first wet tissue 210 and the second wet tissue 220 are not in contact with each other, thereby avoiding excessive contact between the first wet tissue 210 and the second wet tissue 220 due to the surface tension of the chemical solution.

Here, in order to smoothly convey the continuous body of the first wet tissue 210 and the continuous body of the second wet tissue 220, it is preferable that the continuous body of the first wet tissue 210 moderately sticks to the conveying roller 651 and the continuous body of the second wet tissue 220 moderately sticks to the conveying rollers 661 and 662. In addition, on the piling roller 67, it is preferable that the continuous body of the first wet tissue 210 and the continuous body of the second wet tissue 220 stick to each other to such a degree that the wet tissues are not difficult to separate from each other but not easily spaced apart from each other during conveyance.

From the above viewpoints, in a case where, for example, a spun-lace nonwoven fabric mainly composed of rayon fiber (38 g/m$^2$ in basis weight) is used as the first whole cloth 61 and the second whole cloth 62, an amount of the chemical solution with which the continuous body of the first wet tissue 210 and the continuous body of the second wet tissue 220 are to be impregnated in the first impregnation step S4 and the second impregnation step S5 is preferably 150 to 500%, more preferably 200 to 400%, with respect to the mass of each of the first whole cloth 61 and the second whole cloth 62.

In the cutting step S7, the layered body of the continuous body of the first wet tissue 210 and the continuous body of the second wet tissue 220, piled in the piling step S6, is cut by the cutting means 69 at predetermined intervals in a longitudinal direction.

The cutting means 69 is provided with a cutter roller 691 with a blade on a surface thereof and an anvil roller disposed to face the cutter roller 691. In the cutting step S7, the layered body of the continuous body of the first wet tissue 210 and the continuous body of the second wet tissue 220 is conveyed by the first conveyer 68 to between the cutter roller 691 and the anvil roller 692, and then cut to a predetermined length.

In the stacking step S8, the layered body of the continuous body of the first wet tissue 210 and the continuous body of the second wet tissue 220, which is cut in the cutting step S7, is stacked in a plurality of layers by a pusher 71 as the stacking means. More specifically, in the stacking step S8, the layered body of the continuous body of the first wet tissue 210 and the continuous body of the second wet tissue 220, which is cut in the cutting step S7, is conveyed by the second conveyer 70 to a lower side of the pusher 71 and stacked. Then, the pusher 71 moves up and down at predetermined time intervals and pushes the layered body of the continuous body of the first wet tissue 210 and the continuous body of the second wet tissue 220, which is stacked, with a predetermined force.

The wet tissue stacked body 230 formed by alternately stacking the first wet tissue 210 and the second wet tissue 220 in the abovementioned steps, feeding step S1, to stacking step S8, is packed in a packing step (not shown).

In the present mode, the conveying rollers 651, 661 and 662, the piling roller 67, the first conveyer 68 and the second conveyer 70 are all configured with a flat surface. In addition, conveying speed of the first whole cloth 61 and the second whole cloth 62 is substantially the same via the conveying rollers 651, 661 and 662, the piling roller 67, the first conveyer 68 and the second conveyer 70.

In the above-described manufacturing method according to the present mode, the continuous body of the first wet tissue 210 and the continuous body of the second wet tissue 220 are impregnated with the chemical solution from the first face of each, and then the continuous body of the first wet tissue 210 and the continuous body of the second wet tissue 220 are piled such that the second face of the first wet tissue 210 and the first face of the second wet tissue 220 are in contact with each other. In such a configuration, like faces impregnated with the chemical solution of the first wet tissue 210 and the second wet tissue 220 are not in contact with each other, thereby avoiding excessive contact between the first wet tissue 210 and the second wet tissue 220 due to the surface tension of the chemical solution. This can avoid, when the first wet tissue 210 is to be taken out from the wet tissue package 1, the second wet tissue 220 adhering to the first wet tissue 210 and two sheets of the wet tissue 20 being taken out at a time.

In addition, in the first impregnation step S4 and the second impregnation step S5, the chemical solution is applied onto the continuous body of the first wet tissue 210 and the continuous body of the second wet tissue 220 by the impregnation rollers. This allows effective and uniform impregnation of the continuous body of the first wet tissue 210 and the continuous body of the second wet tissue 220 with the chemical solution. In addition, since the chemical solution is not scattered during application of the chemical solution to the continuous body of the first wet tissue 210 and the continuous body of the second wet tissue 220, contamination of a manufacturing facility by scattered chemical solution can be avoided.

It should be noted that, although the layered body of a pair of the first whole cloth 61 and the second whole cloth 62 is cut in the cutting step S7 in the present mode, the present invention is not limited thereto. In other words, the first whole cloth and the second whole cloth can be cut in the cutting step in a state where two or more layered bodies of the pair of the first whole cloth 61 and the second whole cloth 62 are piled up.

In addition, in the present mode, the first whole cloth 61 and the second whole cloth 62 are fed in the feeding step S1 and the first whole cloth 61 and the second whole cloth 62 are piled in the piling step S6; however, the present invention is not limited thereto. In other words, three or more whole cloths can be fed in the feeding step, and these three of more whole clothes can be piled in the piling step. This allows manufacture of a wet tissue package in which wet tissues of three or more different folded shapes are stacked in order.

Furthermore, in the present mode, the first face of the continuous body of the first wet tissue 210 and the first face of the continuous body of the second wet tissue 220 are impregnated with the chemical solution using the impregnation rollers in the first impregnation step S4 and the second impregnation step S5; however, the present invention is not limited thereto. In other words, drops or mist of the chemical solution can be applied to the first face of the continuous body of the first wet tissue 210 and the first face of the continuous body of the second wet tissue 220.

Figure 11:
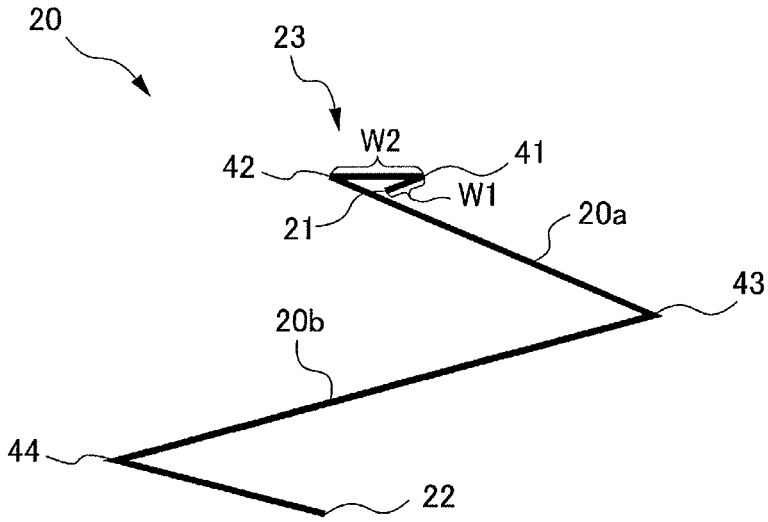
FIG. 11 is a diagram schematically showing a folded state of a wet tissue in a wet tissue package according to a third embodiment.

Next, a third embodiment of the present invention is described hereinafter with reference to FIG. 11. FIG. 11 is a diagram schematically showing a folded state of the wet tissue 20 according to the third embodiment.

The wet tissue package 1 according to the third embodiment is different from the first embodiment in a configuration of the turn-back portion 23, namely, in the folding direction along the first folding line 41.

More specifically, the turn-back portion 23 of the wet tissue 20 in the third embodiment is formed by, as shown in FIG. 11, folding the wet tissue 20 along the first folding line 41 such that the first face 20*a* faces itself. That is, it is folded in a first rotary direction about line 42 and then further folded in the same rotary direction about line 41 so that an end portion of face 20*a* faces the portion of face 20 in between lines 42 and 43.

The wet tissue package 1 according to the third embodiment produces at least the abovementioned effects (1) and (3).

Next, a fourth embodiment of the present invention is described hereinafter with reference to FIG. 12.

The wet tissue package 1A according to the fourth embodiment is different from the first to third embodiments in that a double-folded portion 51 and a folded end portion 52 are provided instead of the turn-back portion 23.

Figure 12:
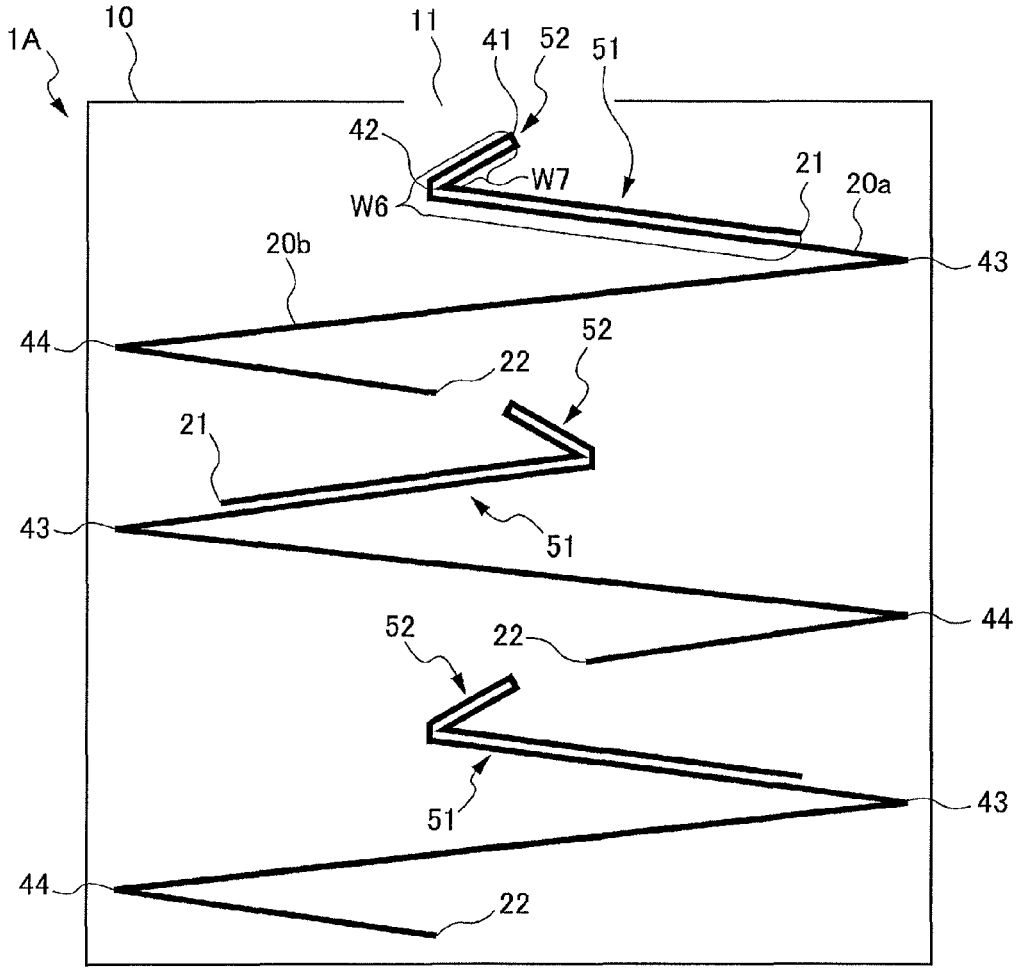
FIG. 12 is a diagram schematically showing a folded state of a wet tissue in a wet tissue package according to a fourth embodiment.

More specifically, the wet tissue package 1A includes, as shown in FIG. 12, the first side edge 21, the double-folded portion 51 that is formed by double-folding the wet tissue 20 at a position away from the first side edge 21 by a predetermined width W6, and the folded end portion 52 that is formed by further turning back an end of the double-folded portion 51. In other words, the folding line 43 is provided away from the position where the wet tissue is double-folded, and the wet tissue is folded along the third folding line 43.

The double-folded portion 51 is formed by folding the wet tissue 20 such that the first face 20*a* faces itself. The double-folded portion 51 is formed such that the first side edge 21 is disposed in front of the third folding line 43 in the state where the wet tissue 20 is double-folded.

The folded end portion 52 is formed by further turning back the double-folded portion 51 to have a width W7 smaller than the predetermined width W6. The folded end portion 52 is formed by folding the wet tissue 20 such that the second face 20*b* faces itself.

Furthermore, comparing to the first embodiment, the first width W1 of each of the plurality of wet tissues is further folded along the second folding line 42 to define a double-folded portion in the wet tissue. Thus, the embodiment of FIG. 12 is similar to that of FIG. 11, except that unlike FIG. 11 where the first width W1 of the wet tissue 20 is short and is not folded further, the corresponding width (e.g., W6) of the wet tissue in FIG. 12 is long and is further folded at the same folding line that corresponds to the second folding line 42 of FIG. 11.

In the fourth embodiment, each of the plurality of wet tissues 20 is disposed such that a part of the folded end portion 52 can be exposed through the opening 11. As shown in FIG. 12, a width of the folded end portion 52 is shorter than that of the opening 11. In other words, the entire width of the folded end portion 52 is exposable through the opening 11. In addition, the folded end portions 52 of two wet tissues 20, which are adjacent to each other in a stacking direction in a state of being stacked, are disposed at positions not overlapping each other in plan view. Furthermore, the plurality of wet tissues 20 are accommodated in the package body 10 in a state of being alternately stacked such that the first side edges 21 thereof are directed to different directions.

The wet tissue package 1A according to the fourth embodiment produces at least the following effects.

(5) The folded end portion 52 is provided by further turning back an end of the double-folded portion 51. As a result, the wet tissue 20 can be configured in a four-layered structure at a position where the folded end portion 52 is provided. As a result, the folded end portion 52 is exposed through the opening 11 so as to be easy to pinch, and thus the wet tissues 20 accommodated in the package body 10 become easier to take out.

(6) The folded end portion 52 of two wet tissues 20, which are adjacent to each other in a stacking direction in a state of being stacked, are disposed at positions not overlapping each other in plan view. As a result, the height of the wet tissue package 1A can be reduced when the plurality of wet tissues 20 are stacked.

Some preferred embodiments of the present invention have been described above; however, the present invention is not limited thereto and can be accordingly modified.

For example, in the above embodiments, the longitudinal direction of the closure flap 30 is disposed along the longitudinal direction of the package body 10; however, the present invention is not limited thereto. In other words, the longitudinal direction of the closure flap can be disposed in any other direction, e.g., along a width direction of the package body, or otherwise.

In addition, in the above embodiments, the package body 10 is configured in a substantially rectangular shape in plan view; however, the present invention is not limited thereto. In other words, the package body 10 can be configured in any other shapes, e.g., a square shape in plan view, or other shapes.

Furthermore, in the above first embodiment, the length of the first width W1 and the length of the second width W2 are configured to be substantially equal; however, the present invention is not limited thereto. For example, the length of the first width W1 can also be configured to be smaller or greater than the length of the second width W2.

Figure 13:
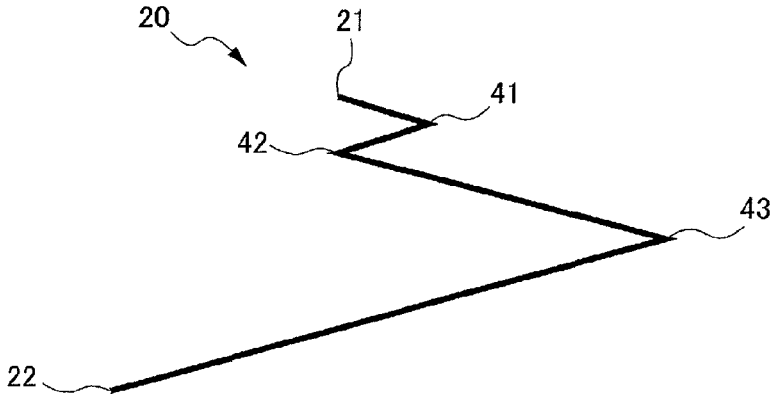
FIG. 13 is a diagram schematically showing a modification of a folded state of a wet tissue.

In addition, in the first to third embodiments, the wet tissue 20 is folded along the first to fourth folding lines 41 to 44; however, the present invention is not limited thereto. In other words, as shown in FIG. 13, the wet tissue 20 can be folded along the first to third folding lines 41 to 43 without providing the fourth folding line.

Figure 14A:
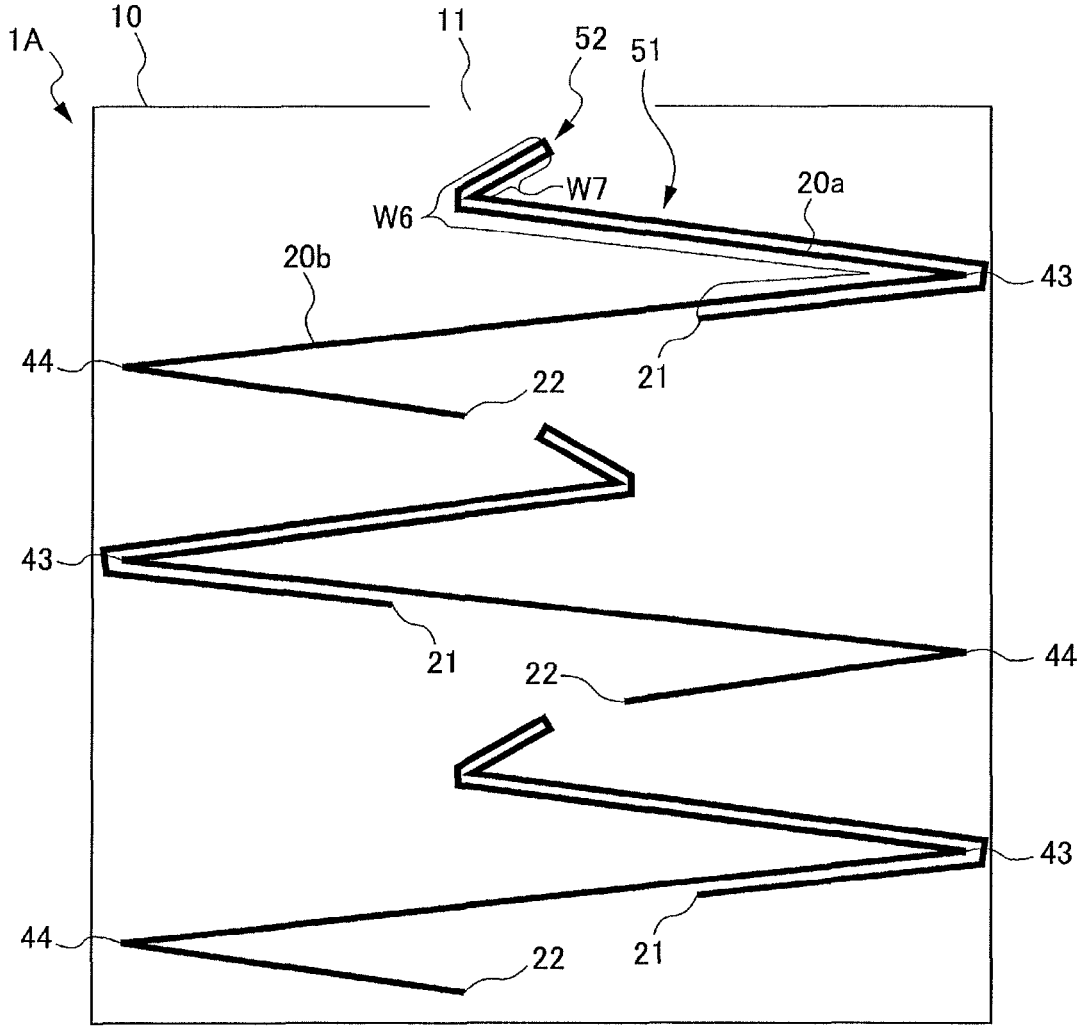
FIG. 14A is a diagram schematically showing an exemplary modification of a folded state of a folded end portion.

In addition, in the fourth embodiment, the double-folded portion 51 is formed by turning back the first side edge 21 so as to be disposed in front of the third folding line 43; however, the present invention is not limited thereto. In other words, as shown in FIG. 14A, the double-folded portion 51 can also be formed by turning back the first side edge 21 so as to be brought between the third folding line 43 and the fourth folding line 44. The embodiment of FIG. 14A is thus similar to FIG. 11 except that the first width W1 (see FIG. 11) is long and is folded not only along the second folding line 42 like FIG. 12, but also along the third folding line 43.

Figure 14B:
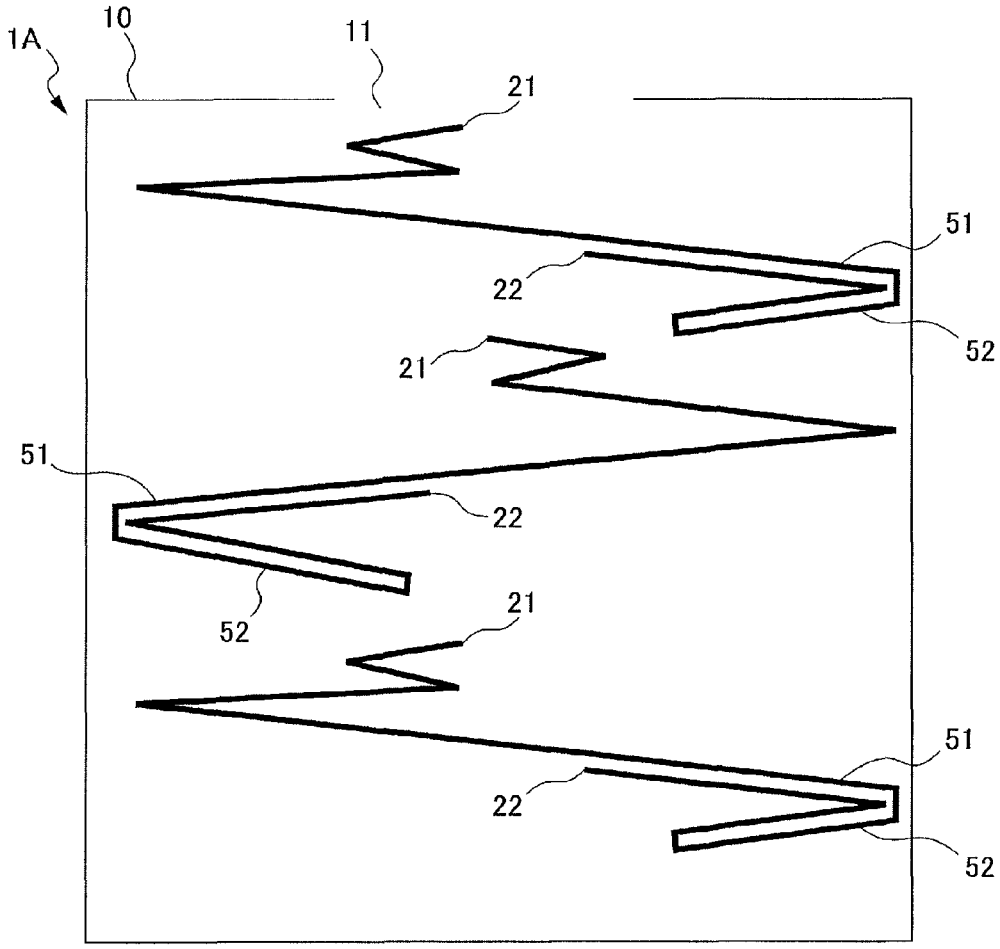
FIG. 14B is a diagram schematically showing another exemplary modification of the folded state of the folded end portion.

Alternatively, as shown in FIG. 14B, the double-folded portion 51 and the folded end portion 52 can also be formed by turning back the second side edge 22 into a double fold with a predetermined width. As compared to FIGS. 6 and 8, the fourth width may include a double-folded portion formed by double-folding the wet tissue along the fourth folding line.

Furthermore, an end portion of a wet tissue at a back side (a side opposite to the opening) and an adjacent end portion of an adjacent wet tissue at an opening side may be folded together (i.e., interfolded), so that each wet tissue thus stacked can be easily picked out. In addition, one or more slits in a width direction can be formed in a folded portion of each wet tissue, which is formed in an inner side of the length in the longitudinal direction of the opening. The modifications disclosed herein provide one or more of the effects detailed at (1) through (6).

Combinations of any one or more embodiments/modifications disclosed herein with any other one or more embodiments/modifications disclosed herein are within the scope of the present invention.

The entire content of Japanese Patent Application 2009-158761 (filed on Jul. 3, 2009) and 2010-067314 (filed on Mar. 24, 2010) are incorporated herein by reference.

The present invention can be applied to a package body for accommodating wet tissues used as baby wipes, a package body for accommodating cleaning sheets for cleaning of plumbed areas such as a kitchen, bathroom and sink, and the like.

Embodiments of the invention also extend to any wet tissue package having a package body having an opening, and a plurality of folded wet tissues accommodated in the package body by stacking in a state of being folded. Each wet tissue is folded such that a side of each of the plurality of wet tissues is disposed to face the opening and forms a side edge that is folded so as to be pinched and removed through the opening.

The invention claimed is:

1. A wet tissue package, comprising:

a package body having an opening defining a width; and a plurality of wet tissues accommodated in the package body in a state of being folded and stacked, wherein a side of each of the plurality of wet tissues facing the opening is folded along first and second folding lines to define a multi-layered structure, and an entire width of the multi-layered structure between the first and second folding lines is less than the width of the opening and is thereby exposable through the opening to facilitate pinching of the multi-layered structure.

2. The wet tissue package according to claim 1, wherein the plurality of wet tissues are accommodated in the package body without being interfolded with each other, wherein each of the plurality of wet tissues includes:

opposite first and second faces;

a first side edge;

the first folding line provided at a position away from the first side edge by a first width;

the second folding line provided at a position away from the first folding line by a second width; and a turn-back portion formed by folding the wet tissue along the first folding line and the second folding line, wherein the turn-back portion is a component of the multi-layered structure and is directed toward the opening, and a part of the turn-back portion is disposed so as to be exposable through the opening.

3. The wet tissue package according to claim 2, wherein the turn-back portion is formed by folding one of the wet tissues along the second folding line such that the first face of the wet tissue faces itself, and along the first folding line such that the second face of the wet tissue faces itself.

4. The wet tissue package according to claim 2, wherein the turn-back portion is formed by folding the wet tissue along both the second folding line and the first folding line such that the first face of the wet tissue faces itself.

5. The wet tissue package according to claim 2, wherein each of the plurality of wet tissues further includes a third folding line provided at a position away from the second folding line by a third width and is folded along the third folding line such that the second face of the wet tissue faces itself, and the turn-back portion is positioned in a substantially central portion of each of the plurality of wet tissues in the folded state in a direction orthogonal to a direction in which the third folding line extends.

6. The wet tissue package according to claim 5, wherein the plurality of wet tissues includes:

a first wet tissue in which the third width has a first length, and a second wet tissue in which the third width has a second length that is smaller than the first length, wherein the first wet tissue and the second wet tissue are stacked alternately; and the turn-back portion of the first wet tissue and the turn-back portion of the second wet tissue are disposed at positions not overlapping each other due to a difference between the first and second lengths of the third widths of the first wet tissue and the second wet tissue.

7. The wet tissue package according to claim 6, wherein each of the plurality of wet tissues further includes a fourth folding line provided at a position away from the third folding line by a fourth width, and is folded along the fourth folding line such that the first face of the wet tissue faces itself.

8. The wet tissue package according to claim 5, wherein each of the plurality of wet tissues further includes a fourth folding line provided at a position away from the third folding line by a fourth width, and is folded along the fourth folding line such that the first face of the wet tissue faces itself.

9. The wet tissue package according to claim 8, wherein the fourth width comprises a double-folded portion formed by double-folding the wet tissue along the fourth folding line.

10. The wet tissue package according to claim 2, wherein each of the plurality of wet tissues, in the folded state, defines an at least four-layered structure where the turn-back portion is formed and a one- or two-layered structure where the turn-back portion is not formed.

11. The wet tissue package according to claim 2, wherein the first width and the second width are substantially equal in length.

12. The wet tissue package according to claim 2, wherein the first width of each of the plurality of wet tissues is further folded along the second folding line to define a double-folded portion in the wet tissue.

13. The wet tissue package according to claim 12, wherein the first width of each of the plurality of wet tissues is further folded along the third folding line.

14. The wet tissue package according to claim 2, wherein the turn-back portion is positioned in a substantially central portion of each of the plurality of wet tissues when folded.

15. The wet tissue package according to claim 1, wherein the plurality of wet tissues are stacked without being interfolded, wherein each of the plurality of wet tissues includes:

a first side edge;

a double-folded portion formed by double-folding the wet tissue at a position away from the first side edge by a predetermined width; and a folded end portion formed by further turning back an end of the double-folded portion.

16. The wet tissue package according to claim 15, wherein each of the plurality of wet tissues further includes a folding line provided away from the position where the wet tissue is double-folded, and is folded along the folding line.

17. The wet tissue package according to claim 16, wherein each of the plurality of wet tissues is further double-folded along said folding line.

18. The wet tissue package according to claim 15, wherein the plurality of wet tissues include a first wet tissue and a second wet tissue stacked alternately; and the folded end portion of the first wet tissue and the folded end portion of the second wet tissue are disposed at positions not overlapping each other.

19. A wet tissue package, comprising:

a package body having an opening defining a width; and a plurality of wet tissues accommodated in the package body in a state of being folded and stacked, wherein a side of each of the plurality of wet tissues facing the opening is folded to define a multi-layered structure an entire width of the multi-layered structure is less than the width of the opening and is thereby exposable through the opening to facilitate pinching of the multi-layered structure, the plurality of wet tissues are accommodated in the package body without being interfolded with each other, each of the plurality of wet tissues includes:

opposite first and second faces;

a first side edge;

a first folding line provided at a position away from the first side edge by a first width;

a second folding line provided at a position away from the first folding line by a second width; and a turn-back portion formed by folding the wet tissue along the first folding line and the second folding line, the turn-back portion is directed toward the opening, and a part of the turn-back portion is disposed so as to be exposable through the opening, each of the plurality of wet tissues further includes a third folding line provided at a position away from the second folding line by a third width and is folded along the third folding line such that the second face of the wet tissue faces itself, the turn-back portion is positioned in a substantially central portion of each of the plurality of wet tissues in the folded state in a direction orthogonal to a direction in which the third folding line extends, the plurality of wet tissues includes:

a first wet tissue in which the third width has a first length, and a second wet tissue in which the third width has a second length that is smaller than the first length, the first wet tissue and the second wet tissue are stacked alternately, and the turn-back portion of the first wet tissue and the turn-back portion of the second wet tissue are disposed at positions not overlapping each other.

* * * * *